US007887038B2

(12) United States Patent
Shigeno et al.

(10) Patent No.: US 7,887,038 B2
(45) Date of Patent: Feb. 15, 2011

(54) SHEET MATERIAL FEEDING DEVICE

(75) Inventors: Kenji Shigeno, Yokohama (JP); Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/262,050

(22) Filed: Oct. 30, 2008

(65) Prior Publication Data

US 2009/0108516 A1 Apr. 30, 2009

(30) Foreign Application Priority Data

Oct. 31, 2007 (JP) ..... 2007-283614

(51) Int. Cl.
*B65H 5/22* (2006.01)

(52) U.S. Cl. ..... 271/9.08; 217/9.07; 217/9.11; 217/117; 217/126; 217/127

(58) Field of Classification Search ..... 271/9.07, 271/9.08, 9.11, 117, 126, 127
See application file for complete search history.

(56) References Cited

U.S. PATENT DOCUMENTS 4,108,427 A * 8/1978 Komori et al. ..... 271/9.09
5,287,164 A * 2/1994 Watanabe ..... 399/391
6,406,201 B1 * 6/2002 Beretta et al. ..... 400/605
7,600,745 B2 * 10/2009 Asada ..... 271/9.08
7,600,746 B2 * 10/2009 Chino ..... 271/9.11
7,681,875 B2 * 3/2010 Asada et al. ..... 271/9.08
2006/0262355 A1 11/2006 Kurata et al.

FOREIGN PATENT DOCUMENTS

JP 2002-249248 9/2002

* cited by examiner

*Primary Examiner*—Stefanos Karmis
*Assistant Examiner*—Jeremy Severson
(74) *Attorney, Agent, or Firm*—Canon USA Inc IP Div

(57) ABSTRACT

A compact sheet material feeding device with a small height is provided. The device includes a lower sheet material stacking unit, an upper sheet material stacking unit disposed above and movable relative to the lower sheet material stacking unit, a feeding mechanism swingable between a first position relatively near to the lower sheet material stacking unit and a second position away from the lower sheet material stacking unit, a holding member configured to hold the feeding mechanism at the second position, and a pressing plate configured to move sheet material stacked in the upper sheet material stacking unit toward the feeding mechanism so that the sheet material is pressed against the feeding mechanism.

10 Claims, 9 Drawing Sheets

SHEET MATERIAL FEEDING DEVICE

BACKGROUND OF THE INVENTION

1. Field of the Invention

The present invention relates to sheet material feeding devices that feed sheet materials, as recording media, to recording apparatuses such as facsimiles, copiers, and printers.

2. Description of the Related Art

There are many known commercial recording apparatuses each including a plurality of sheet material stacking units that are arranged one above the other. An example of such recording apparatuses is shown in FIG. 10.

FIG. 10 is a schematic cross-sectional view of a known recording apparatus that includes a plurality of sheet material stacking units. The recording apparatus in FIG. 10 includes a first sheet material stacking unit 45 and a second sheet material stacking unit 46 that are arranged one above the other. The recording apparatus further includes, between the first sheet material stacking unit 45 and the second sheet material stacking unit 46, a first feeding mechanism 44 having a feeding roller 42 that feeds sheet material P4 from the first sheet material stacking unit 45. Above the second sheet material stacking unit 46, the recording apparatus includes a second feeding mechanism 43 having a feeding roller 41 that feeds sheet material P3 from the second sheet material stacking unit 46. In short, the first sheet material stacking unit 45, the first feeding mechanism 44, the second sheet material stacking unit 46, and the second feeding mechanism 43 are arranged in that order from the bottom to the top.

FIGS. 11A and 11B show another known recording apparatus in which a single feeding mechanism accommodates a plurality of sheet material stacking units.

In the recording apparatus shown in FIGS. 11A and 11B, sheet material is fed from each of the plurality of sheet material stacking units by the use of the single feeding mechanism. Specifically, the sheet material is fed in the following manner.

To feed sheet material P6 stacked in a first sheet material stacking unit 53 to a recording unit, referring to FIG. 11B, a second sheet material stacking unit 52 is retracted to a −Y side with respect to a feeding mechanism 51 in a sheet material conveying direction and is secured there. In this state, a feeding roller 51*a* of the feeding mechanism 51 presses the sheet material P6 stacked in the first sheet material stacking unit 53, and the sheet material P6 is fed toward a pair of rollers 54 disposed in a sheet material conveying path. The sheet material P6 that has reached the pair of rollers 54 is further delivered through pairs of rollers 55 and 56 and to the recording unit.

To feed sheet material P5 stacked in a second sheet material stacking unit 52 to the recording unit, referring to FIG. 11A, the second sheet material stacking unit 52 is moved to a +Y side in the sheet material conveying direction and is secured below the feeding mechanism 51. In this state, the feeding roller 51*a* of the feeding mechanism 51 presses the sheet material P5 stacked in the second sheet material stacking unit 52, and the sheet material P5 is fed toward the pair of rollers 54 as in the case of feeding the sheet material P6 from the first sheet material stacking unit 53. The sheet material P5 that has reached the pair of rollers 54 is further delivered through the pairs of rollers 55 and 56 and to the recording unit, as in the case of the sheet material P6.

In the recording apparatus having such a configuration, it is general that the second sheet material stacking unit 52 is provided for sheet materials of relatively small sizes, such as the postcard size and the L size. In contrast, it is general that the first sheet material stacking unit 53 is provided for sheet materials of relatively large sizes, ranging from A5 to A4.

The configuration shown in FIG. 10 has a problem in that the necessity of disposing the feeding mechanism 44 between the sheet material stacking unit 45, the lower one, and the sheet material stacking unit 46, the upper one, increases the height of the sheet material feeding device and, consequently, the height of the recording apparatus.

In the configuration shown in FIGS. 11A and 11B, in which the single feeding mechanism 51 is shared between the sheet material stacking units 52 and 53, the heights of the sheet material feeding device and the recording apparatus can be made smaller than in the configuration shown in FIG. 10. However, the configuration shown in FIGS. 11A and 11B has another problem. In both configurations shown in FIG. 10 and FIGS. 11A and 11B, an angle of a certain magnitude needs to be formed between the feeding roller and the sheet material because the sheet material can only be fed by a force (biting force) with which the feeding roller presses the sheet material.

From this viewpoint, the configuration shown in FIGS. 11A and 11B forms angles θ1 and θ2 between the feeding mechanism 51 and the sheet materials P5 and P6 by having the feeding mechanism 51 angled with respect to the sheet material stacking units 52 and 53. However, since the feeding mechanism 51 is shared between the upper and lower sheet material stacking units 52 and 53, the angle θ1 formed between the feeding mechanism 51 and the sheet material P5 stacked in the sheet material stacking unit 52 positioned nearer to the feeding mechanism 51 is smaller than the angle θ2. As a result, the force (biting force) with which the feeding roller 51*a* presses the sheet material P5 is reduced and, therefore, feeding of the sheet material may become unstable.

From the viewpoint of realizing stable feeding of the sheet material, the angles θ1 and θ2 are both desired to be within the range of about 5 to 20 degrees. However, if the feeding mechanism 51 and the sheet material stacking units 52 and 53 are arranged such that the angles θ1 and θ2 both fall within the foregoing range, the number of stackable sheets of the sheet materials P5 and P6 and the height of the sheet material stacking units directly affect the height of the sheet material feeding device and, consequently, the height of the recording apparatus.

SUMMARY OF THE INVENTION

The present invention provides a compact sheet material feeding device in which the overall height of sheet material stacking units is short.

According to an aspect of the present invention, a sheet material feeding device in which sheet materials stacked in a plurality of sheet material stacking units are fed selectively is provided. The device includes a first sheet material stacking unit, a second sheet material stacking unit disposed above the first sheet material stacking unit and movable relative to the first sheet material stacking unit, a feeding roller movable between a first position where the feeding roller presses the sheet material stacked in the first sheet material stacking unit and a second position where the feeding roller is spaced apart from the first sheet material stacking unit, a holding member holding the feeding roller when the feeding roller is at the second position and releasing the feeding roller when the second sheet material stacking unit is in a state of being retracted from a position between the first sheet material stacking unit and the feeding roller, thereby causing the feeding roller to press the sheet material stacked in the first sheet material stacking unit, and a pressing member configured to move the sheet material stacked in the second sheet material stacking unit toward the feeding roller so as to cause the sheet material to be pressed against the feeding roller, the pressing member causing the sheet material stacked in the second sheet material stacking unit to be pressed against the feeding roller when the second sheet material stacking unit is positioned between the first sheet material stacking unit and the feeding roller while the holding member is holding the feeding roller at the second position.

Further features of the present invention will become apparent from the following description of exemplary embodiments with reference to the attached drawings.

DESCRIPTION OF THE EMBODIMENTS

Exemplary embodiments of a sheet material feeding device according to the present invention will now be described in detail with reference to the drawings.

First Embodiment

A first embodiment of the sheet material feeding device according to the present invention will be described taking an exemplary case where sheet material to be fed is paper. Needless to say, the sheet material to be fed by the sheet material feeding device according to the following embodiments of the present invention is not limited to paper, and may be any other sheet material such as film.

The sheet material feeding device according to each embodiment of the present invention is configured with the proviso that it is used as a part of an apparatus such as a recording apparatus as a printer, an image forming apparatus as a copier or a printing apparatus, and an image reading apparatus as a facsimile or a scanner. Hence, in the following description, the overall configuration of a recording apparatus to which the sheet material feeding device according to each embodiment of the present invention is applied will be generally described first, and then the detailed configuration of the sheet material feeding device according to each embodiment of the present invention will be described. In the general description of the recording apparatus, components will be described in order from the upstream side to the downstream side in a sheet material conveying direction.

Figure 1:
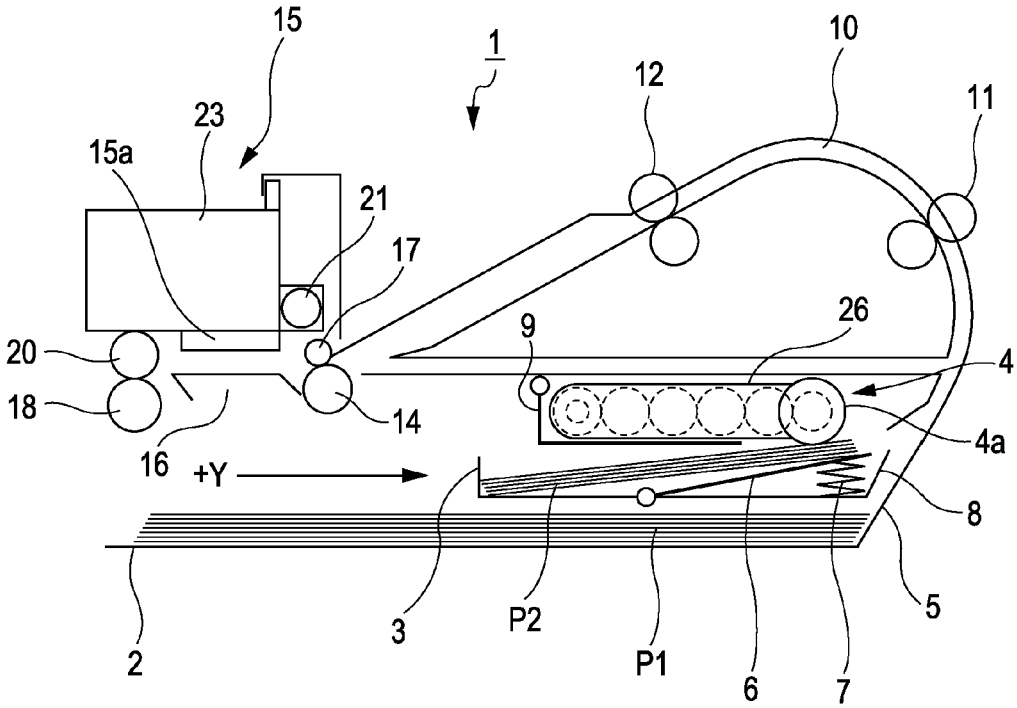
FIG. 1 is a schematic cross-sectional view of a recording apparatus, in a certain state, that includes a sheet material feeding device according to a first embodiment of the present invention.
Figure 2:
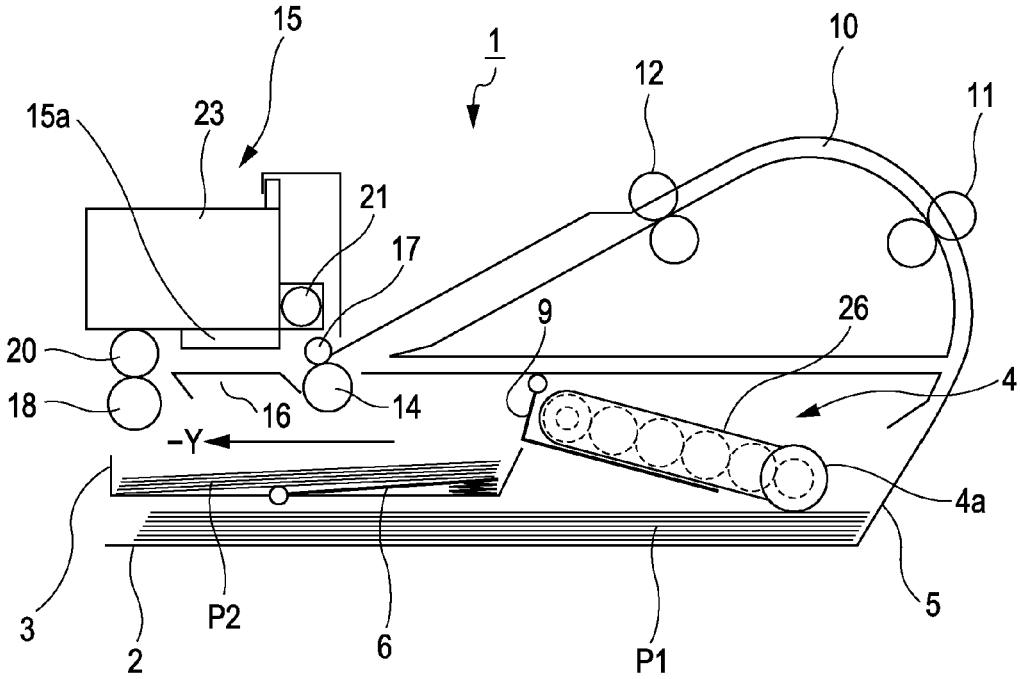
FIG. 2 is a schematic cross-sectional view of the recording apparatus, in another state, that includes the sheet material feeding device according to the first embodiment.

FIGS. 1 and 2 are schematic cross-sectional views of a recording apparatus 1 to which the sheet material feeding device according to the first embodiment is applied.

The recording apparatus 1 includes a lower sheet material stacking unit 2, as a first sheet material stacking unit, and an upper sheet material stacking unit 3, as a second sheet material stacking unit. Sheet material is fed selectively from either of the sheet material stacking units 2 and 3 to a recording unit 15. Feeding from each of the sheet material stacking units 2 and 3 is performed by a feeding unit. The feeding unit in the first embodiment is a feeding mechanism 4 that includes at least a feeding roller 4*a* and a support arm (swing arm 26), the support arm rotatably holding at one end thereof the feeding roller 4*a* and being swingably supported at the other end thereof.

The lower sheet material stacking unit 2 is a sheet feeding cassette of a large size relative to the size of the upper sheet material stacking unit 3. Some sheets of sheet material P1 stacked in the lower sheet material stacking unit 2 while being regulated by a side guide and an end guide (both not shown) are moved by the feeding roller 4*a* toward a sheet-separating sloping portion 5. The topmost one of the sheets of the sheet material P1 that has been moved toward the sheet-separating sloping portion 5 is separated from the others at the sheet-separating sloping portion 5, and is conveyed to a conveying path 10.

The upper sheet material stacking unit 3 is a sheet feeding cassette of a small size relative to the size of the lower sheet material stacking unit 2. A plurality of sheets of sheet material P2 are stacked (set) in the upper sheet material stacking unit 3 while being regulated by a side guide 24 and an end guide 25 (see FIG. 4). As in the case of the sheet material P1, some sheets of the sheet material P2 stacked in the upper sheet material stacking unit 3 are moved by the feeding roller 4*a* toward a sheet-separating sloping portion 8. The topmost one of the sheets of the sheet material P2 is separated from the others at the sheet-separating sloping portion 8, and is conveyed to the conveying path 10.

The sheet of the sheet material P1 or P2 (the sheet materials P1 and P2 are hereinafter generally referred to as the "sheet material P") that has been conveyed to the conveying path 10, which is commonly used, is further conveyed toward the recording unit 15 by pairs of conveying rollers 11 and 12 disposed in the conveying path 10.

The recording unit 15 includes a main conveying roller 14 that conveys the sheet material P to a recording area, and a platen 16 that is disposed at a position facing a recording head 15*a* and supports the sheet material P from below. The main conveying roller 14 is driven by a drive unit (not shown). A pinch roller 17 is disposed in such a manner as to be pressed against the main conveying roller 14. The pinch roller 17 is driven by a friction driving force produced by the main conveying roller 14 and the sheet material P. The pinch roller 17 is urged by a spring member (not shown) against the main conveying roller 14, whereby a force for conveying the sheet material P is produced.

On the downstream side of the recording area, a plurality of eject rollers 18 are disposed in such a manner as to be parallel to the main conveying roller 14, and a plurality of spurs 20 are provided in correspondence with the eject rollers 18. The spurs 20 are each driven to rotate while pressing the sheet material P with the aid of an urging member (not shown). The eject rollers 18 stabilize the behavior of the sheet material P being subjected to image recording and, when image recording is finished, output the sheet material P to a sheet output tray (not shown).

Next, an image recording operation of the recording apparatus 1 configured as described above will be described. The sheet material P that has been fed from the sheet material stacking unit 2 or 3 passes through the conveying path 10 and is further conveyed by the main conveying roller 14 and the pinch roller 17 while being pinched therebetween. When the sheet material P reaches the recording area on the platen 16, a carriage 23 having the recording head 15*a* is moved back and forth by a carriage motor (not shown) along a carriage shaft 21 in a direction orthogonal to a sheet conveying direction. While the carriage 23 is being moved, ink is ejected from the recording head 15*a* toward the sheet material P in accordance with a recording command, whereby an image is recorded on the sheet material P.

While being conveyed and subjected to recording, the sheet material P is pinched between the main conveying roller 14 and the pinch roller 17 on the upstream side with respect to the recording area, and between the eject rollers 18 and the spurs 20 on the downstream side. When recording on the sheet material P in a predetermined region starting from the leading end thereof is finished, the trailing end of the sheet material P comes out of the nip between the main conveying roller 14 and the pinch roller 17. Subsequently, the sheet material P is conveyed by the eject rollers 18 and the spurs 20. Therefore, recording with the recording head 15*a* on the sheet material P can be performed to the very end of the sheet material P.

Next, the configuration including the lower sheet material stacking unit 2, the upper sheet material stacking unit 3, and the feeding mechanism 4 will be described with reference to FIGS. 1 to 6.

Figure 3:
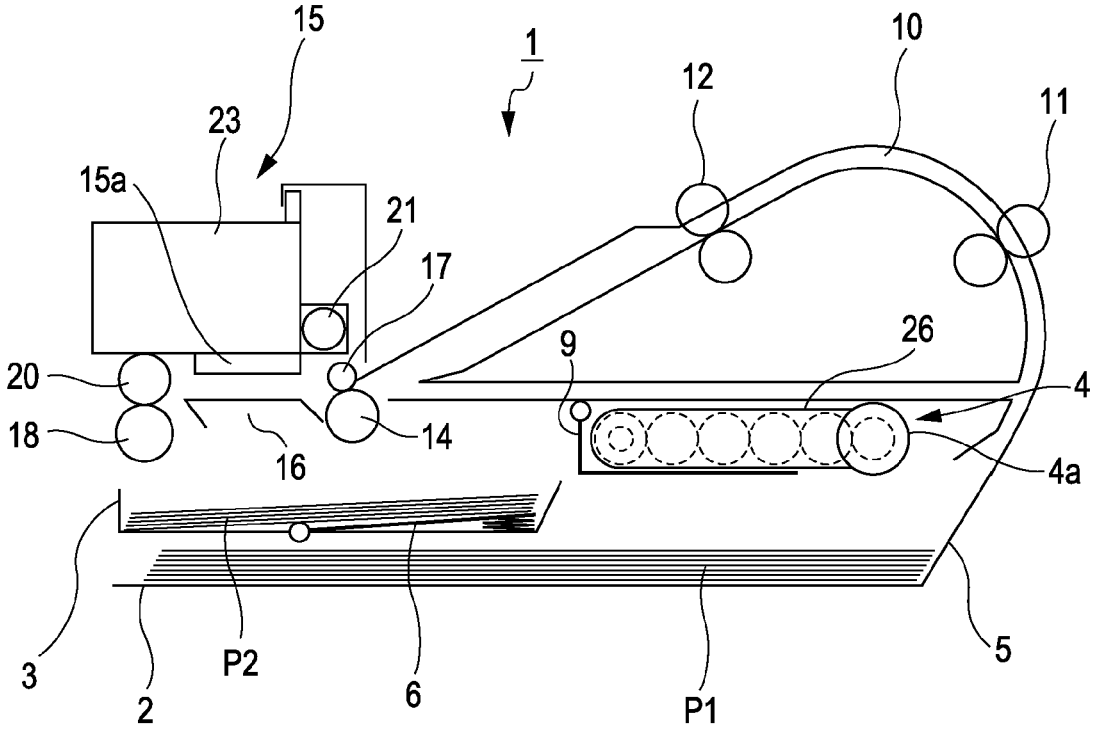
FIG. 3 is a schematic cross-sectional view of the recording apparatus, in another state, that includes the sheet material feeding device according to the first embodiment.

Like FIGS. 1 and 2, FIG. 3 is a schematic cross-sectional view of the recording apparatus 1. In the first embodiment, the upper sheet material stacking unit 3 is for sheet materials of small sizes and the lower sheet material stacking unit 2 is for sheet materials of large sizes. The small sizes include the name card size to the 2L size, and the large sizes include the A5 size to the A4 size.

The sheet material stacking units 2 and 3 and the feeding mechanism 4 shown in FIG. 3 are in a waiting state, in which they wait for a sheet material feeding command to be issued from the recording apparatus 1. In the waiting state, the feeding mechanism 4 is held in a substantially horizontal state by a holding member 9 at a position (second position) relatively spaced apart from the lower sheet material stacking unit 2.

The upper sheet material stacking unit 3 and the feeding mechanism 4 shown in FIG. 1 are in a state at the start of an operation in which the sheet material P2 of a small size is fed to an area in which the recording head 15*a* can perform recording, the operation being started in response to a command to feed the sheet material P2 issued from the recording apparatus 1. The upper sheet material stacking unit 3 in this state is shown in FIG. 4 as a top view of the recording apparatus 1.

Figure 5:
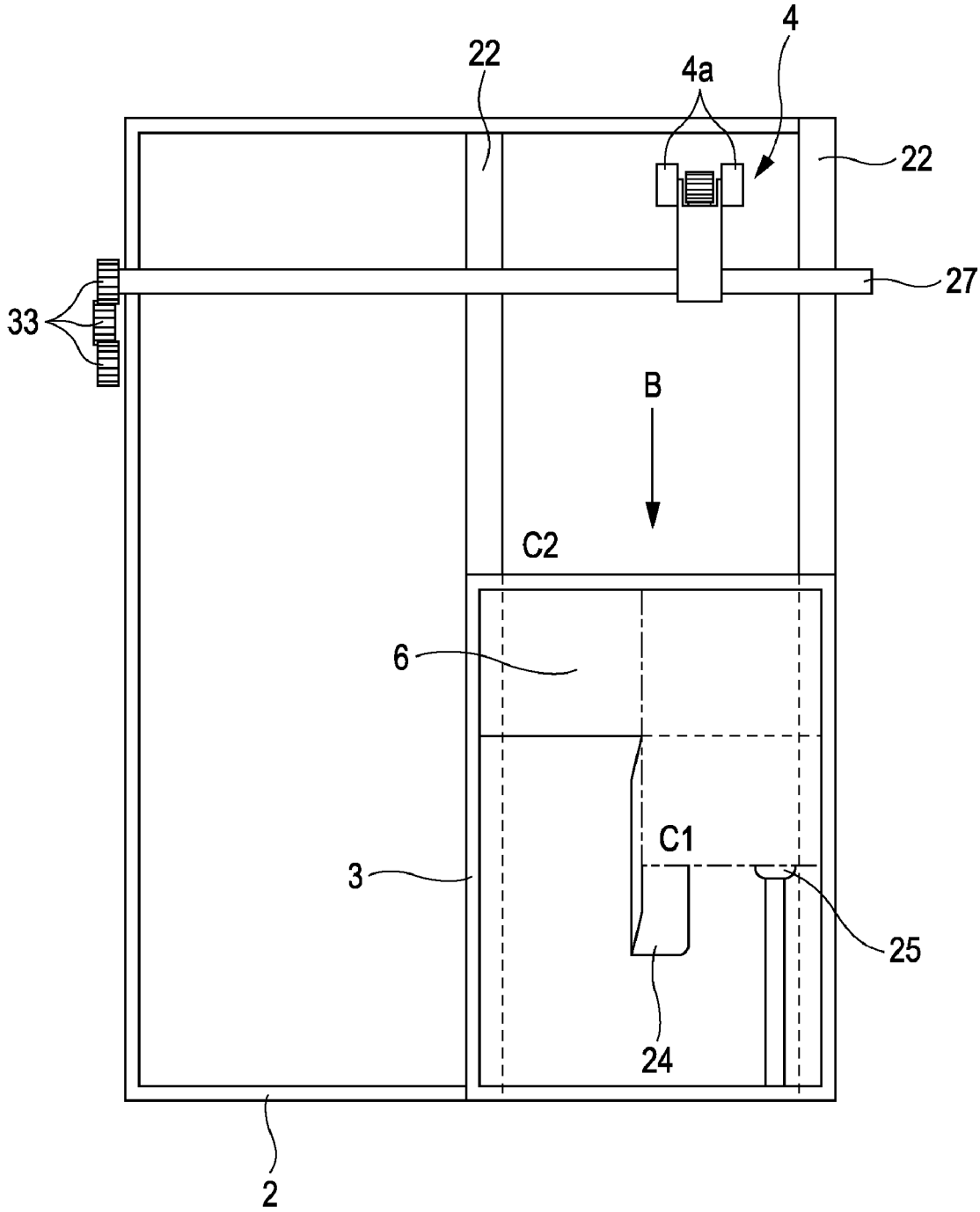
FIG. 5 is a schematic top view of the sheet material stacking units and the feeding mechanism in the recording apparatus that is in the state shown in FIG. 2.
Figure 6:
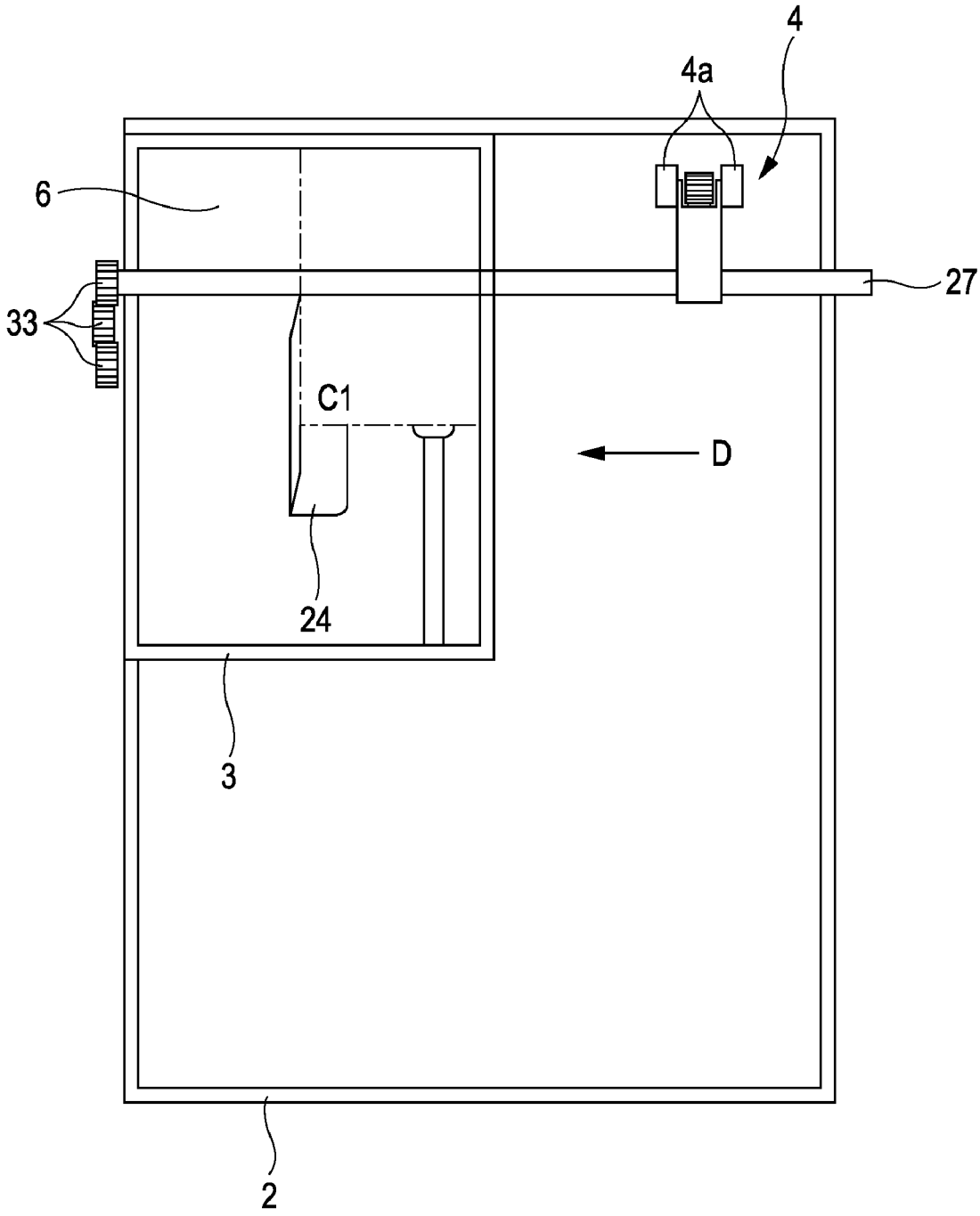
FIG. 6 is a schematic top view showing an alternative of a position at which an upper one of the sheet material stacking units included in the sheet material feeding device according to the first embodiment is retracted.

The lower sheet material stacking unit 2 and the feeding mechanism 4 shown in FIG. 2 are in a state at the start of an operation in which the sheet material P1 of a large size is fed to the area in which the recording head 15*a* can perform recording, the operation being started in response to a command to feed the sheet material P1 issued from the recording apparatus 1. The lower sheet material stacking unit 2 in this state is shown in FIG. 5 as a top view of the recording apparatus 1.

Figure 4:
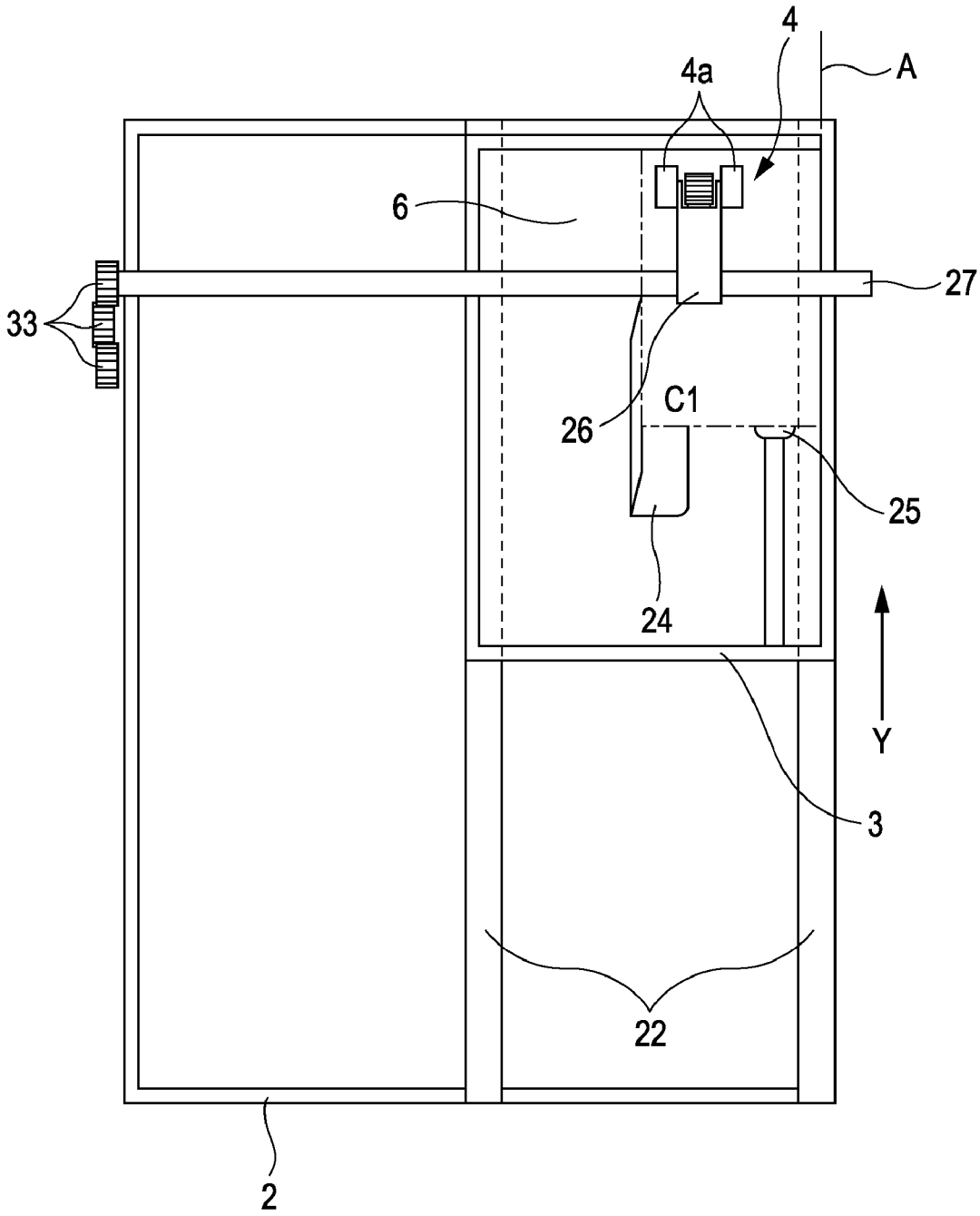
FIG. 4 is a schematic top view of sheet material stacking units and a feeding mechanism in the recording apparatus that is in the state shown in FIG. 1.

When a command to feed the sheet material P2 of a small size is issued from the recording apparatus 1, the state of the sheet material stacking units 2 and 3 and the feeding mechanism 4 changes from the waiting state shown in FIG. 3 to the state shown in FIGS. 1 and 4. Specifically, the upper sheet material stacking unit 3 having the sheet material P2 of a small size is moved along support rails 22 in the Y direction indicated by the arrow in FIG. 4, and is stopped at a predetermined position, thereby being ready for feeding of the sheet material P2 stacked therein. Subsequently, to change the position of the sheet material P2 so that the sheet material P2 is pressed against the feeding roller 4*a*, a pressing plate 6 provided to the upper sheet material stacking unit 3 is pushed up with the aid of a resilient pressing member 7. Accordingly, the sheet material P2 stacked in the upper sheet material stacking unit 3 is pressed against the feeding roller 4*a* that is held at the second position while a topmost sheet C1 of the sheet material P2 is in direct contact with the feeding roller 4*a*. Consequently, some sheets of the sheet material P2 are pushed out in the conveying direction under a feeding force produced as a combination of a pressing force applied by the pressing plate 6 and the resilient pressing member 7 and a rotating force applied by the feeding roller 4*a* in the conveying direction. Then, the topmost sheet C1 is separated from the other sheets with the aid of the sheet-separating sloping portion 8. The separated sheet C1 of the sheet material P2 is fed through the conveying path 10 to the recording unit 15. Recording on the sheet C1 of the sheet material P2 that has been fed to the recording unit 15 is performed in accordance with a recording command, as described above.

At the completion of the above-described recording operation, the sheet C1 of the sheet material P2 after being subjected to recording is output. When the recording command is fulfilled, the sheet material stacking units 2 and 3 and the feeding mechanism 4 restore the state shown in FIG. 1 or the waiting state shown in FIG. 3, in which they wait for feeding of the sheet material, in accordance with the next instruction from the recording apparatus 1.

Next, an operation performed in a case where a command to feed the sheet material P1 of a large size is issued from the recording apparatus 1 will be described.

When a command to feed the sheet material P1 of a large size is issued from the recording apparatus 1 while the sheet material stacking units 2 and 3 and the feeding mechanism 4 are in the waiting state as shown in FIG. 3, the holding member 9 releases the feeding mechanism 4, whereby the feeding mechanism 4 swings to a position (first position) relatively close to the lower sheet material stacking unit 2. Specifically, when the holding member 9 releases the feeding mechanism 4, a driving force is transmitted from a drive source (not shown) to a series of transmission gears 33 shown in FIG. 5. Accordingly, the swing arm 26 (see FIG. 2) holding the feeding roller 4*a* swings about a swing arm support shaft 27, and the feeding roller 4*a* is lowered toward the lower sheet material stacking unit 2. The feeding roller 4*a* that has been lowered presses the sheet material P1 of a large size stacked in the lower sheet material stacking unit 2 while being in direct contact with a topmost sheet C2 of the sheet material P1. As a result, some sheets of the sheet material P1 are pushed out in the conveying direction. Then, the topmost sheet C2 is separated from the other sheets with the aid of the sheet-separating sloping portion 5. The separated sheet C2 is fed through the conveying path 10 to the recording unit 15. Recording on the sheet C2 of the sheet material P1 that has been fed to the recording unit 15 is performed in accordance with a recording command, as described above.

At the completion of the above-described recording operation, the sheet C2 of the sheet material P1 after being subjected to recording is output. When the recording command is fulfilled, the sheet material stacking units 2 and 3 and the feeding mechanism 4 restore the state shown in FIG. 2 or the state shown in FIG. 3 (the waiting state in which they wait for feeding of the sheet material), in accordance with the next instruction from the recording apparatus 1.

When the sheet material P1 of a large size is fed, the upper sheet material stacking unit 3 is positioned in the rear of the feeding mechanism 4 (as indicated by the arrow B in FIG. 5). In other words, the upper sheet material stacking unit 3 is retracted from the position between the lower sheet material stacking unit 2 and the feeding mechanism 4, so as not to prevent the behavior of the feeding roller 4*a* of the feeding mechanism 4 to press the sheet material P1. Needless to say, referring to FIG. 6, the upper sheet material stacking unit 3 may also be retracted in the width direction of the sheet material P2 (C1) (a direction indicated by the arrow D orthogonal to the sheet material conveying direction) so as not to prevent the behavior of the feeding roller 4*a* to press the sheet material P1.

Figure 7:
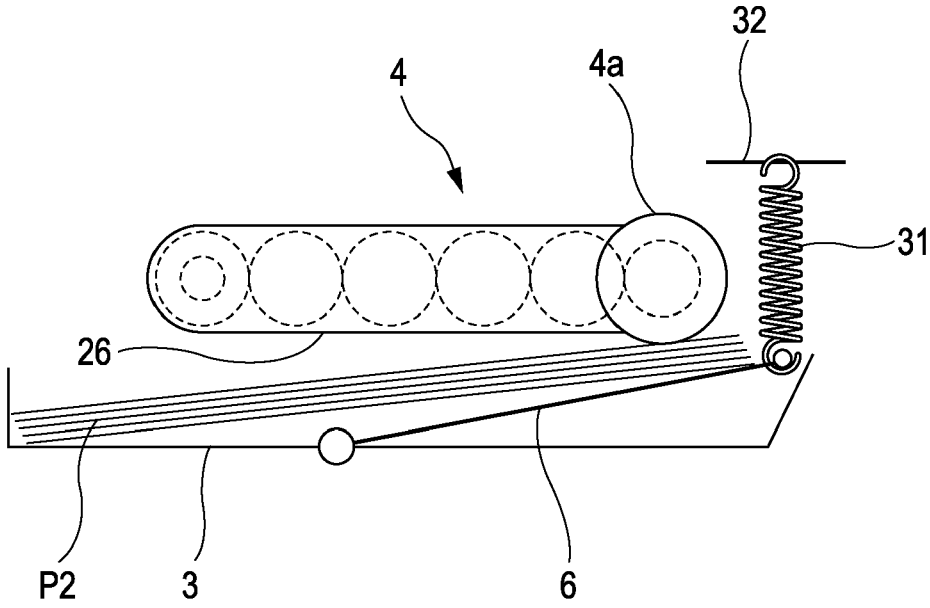
FIG. 7 is a schematic cross-sectional view showing a modification of the sheet material feeding device according to the first embodiment.

The configuration described in the first embodiment includes the resilient pressing member 7 that produces a force to push up the pressing plate 6 from below so that the sheet material P2 stacked in the upper sheet material stacking unit 3 is pressed against the feeding roller 4*a* while the topmost sheet C1 of the sheet material P2 is in direct contact with the feeding roller 4*a*. Alternatively, referring to FIG. 7, another resilient pressing member 31 that produces a force to pull up the pressing plate 6 from above may be used to realize the same. In the latter case, it is desirable that an end of the resilient pressing member 31 be secured to a resilient member securing member 32 disposed above the pressing plate 6.

As described above, the sheet material feeding device according to the first embodiment differs from the known art in the principle of producing a feeding force required in the operation of feeding the sheet material from each of a plurality of sheet material stacking units (in particular, the operation of feeding the sheet material from the upper sheet material stacking unit). Specifically, in the known art, the feeding roller is tilted with respect to the sheet material so that the feeding roller is pressed against the sheet material, whereby the feeding force is produced.

In contrast, in the sheet material feeding device according to the first embodiment, the sheet material is brought to be pressed against the feeding roller, which is held in a substantially horizontal state, with the aid of a pressing member, whereby the feeding force is produced. Therefore, the height of the device can be reduced and, simultaneously, a sufficient pressing force (feeding force) can be produced.

In the first embodiment, the sizes of the sheet materials to be stacked in the respective sheet material stacking units are specified as described above. However, such specifications are only provided as a matter of descriptive convenience, and there are no limitations on the sizes of the sheet materials to be stacked in the respective sheet material stacking units. In other words, there are no specific limitations on the dimensions of the sheet material stacking units. Even in the case where the sizes of the sheet materials to be stacked in the respective sheet material stacking units are specified, it is not necessary to arrange the stacking unit for large-sized sheet material below the stacking unit for small-sized sheet material. That is, the order of arranging the stacking units is not limited in any way.

Second Embodiment

A second embodiment of the sheet material feeding device according to the present invention will be described with reference to FIG. 8. The basic configuration of the sheet material feeding device according to the second embodiment is the same as that of the sheet material feeding device according to the first embodiment. Therefore, description of the components common to both embodiments are omitted.

Figure 8:
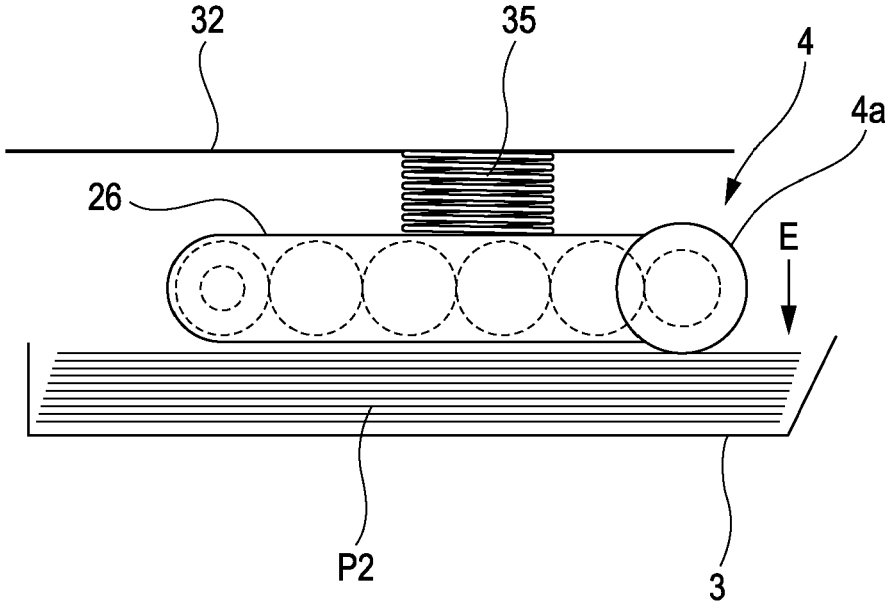
FIG. 8 is a schematic enlarged cross-sectional view showing relevant parts of a sheet material feeding device according to a second embodiment.

FIG. 8 is a schematic cross-sectional view showing the upper sheet material stacking unit 3 and the feeding mechanism 4 included in the sheet material feeding device according to the second embodiment. In the sheet material feeding device according to the second embodiment, when the sheet material P2 stacked in the upper sheet material stacking unit 3 is fed, a resilient pressing member 35 applies a pressing force to the swing arm 26 from above in a direction indicated by the arrow E. In response to this, the feeding roller 4*a* held by the swing arm 26 is caused to press the sheet material P2 stacked in the upper sheet material stacking unit 3. In a case where the upper sheet material stacking unit 3 is full of the sheet material P2, the swing arm 26 and the feeding roller 4*a* are maintained in a substantially horizontal state while the pressing force of the resilient pressing member 35 is applied to the sheet material P2, with the resilient pressing member 35 in direct contact with the topmost sheet of the sheet material P2.

An end of the resilient pressing member 35 is secured to the securing member 32 disposed across the resilient pressing member 35 from the upper sheet material stacking unit 3. In such a configuration, a pressing force can be applied to the swing arm 26 even if there is only one sheet of the sheet material P2 in the upper sheet material stacking unit 3.

The sheet material feeding device according to the second embodiment also produces the same advantageous effect as in the sheet material feeding device according to the first embodiment. That is, a compact sheet material feeding device with a reduced height can be realized.

Third Embodiment

A third embodiment of the sheet material feeding device according to the present invention will be described with reference to FIG. 9. The basic configuration of the sheet material feeding device according to the third embodiment is the same as that of the sheet material feeding device according to the first embodiment. Therefore, description of the components common to both embodiments are omitted and only differences between the two embodiments will be described.

Figure 9:
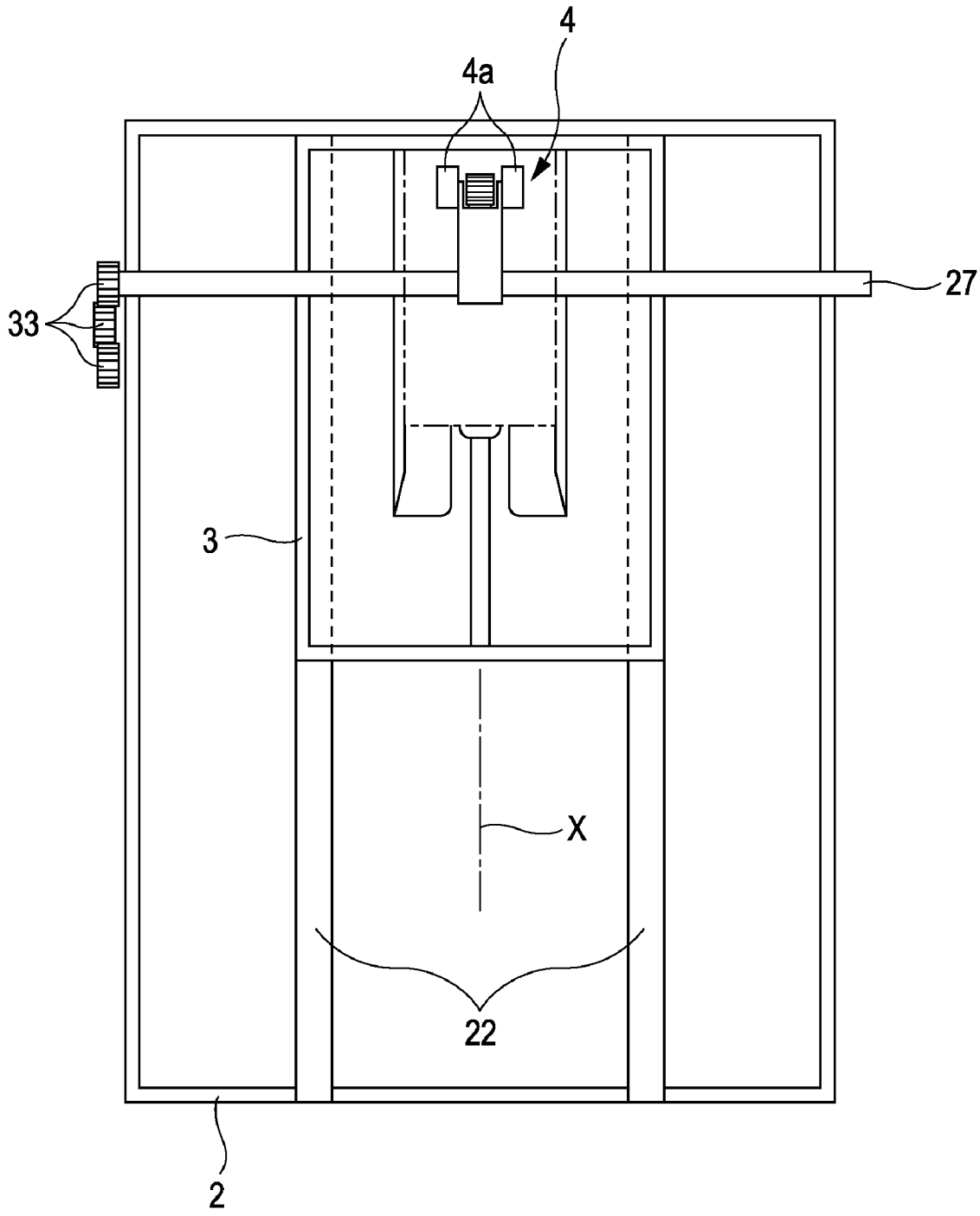
FIG. 9 is a schematic top view of sheet material stacking units and a feeding mechanism included in a sheet material feeding device according to a third embodiment.
Figure 10:
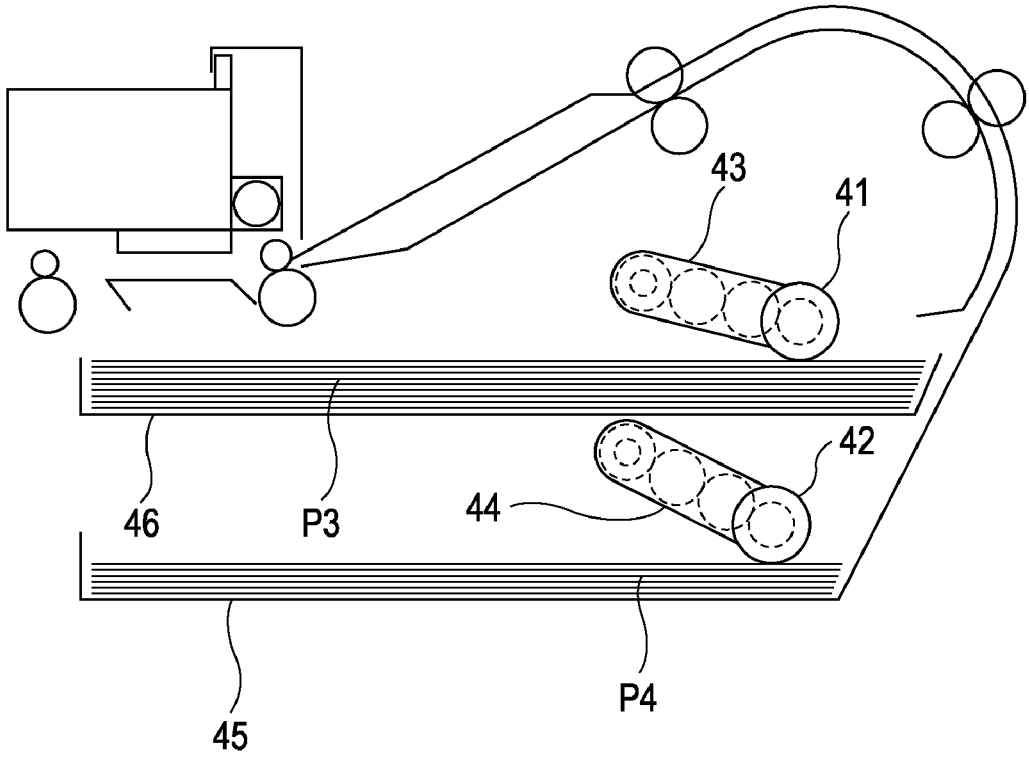
FIG. 10 PRIOR ART
FIG. 10 is a schematic cross-sectional view of an exemplary recording apparatus that includes a known sheet material feeding device.
Figure 11A:
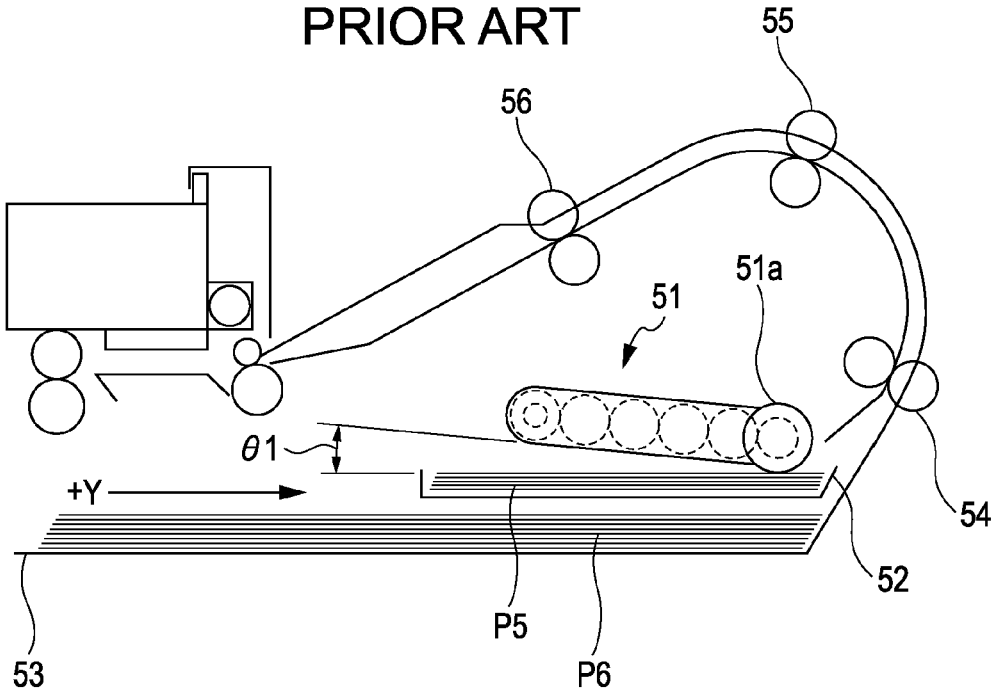
FIG. 11A PRIOR ART
FIGS. 11A and 11B are schematic cross-sectional views of another exemplary recording apparatus that includes a known sheet material feeding device.
Figure 11B:
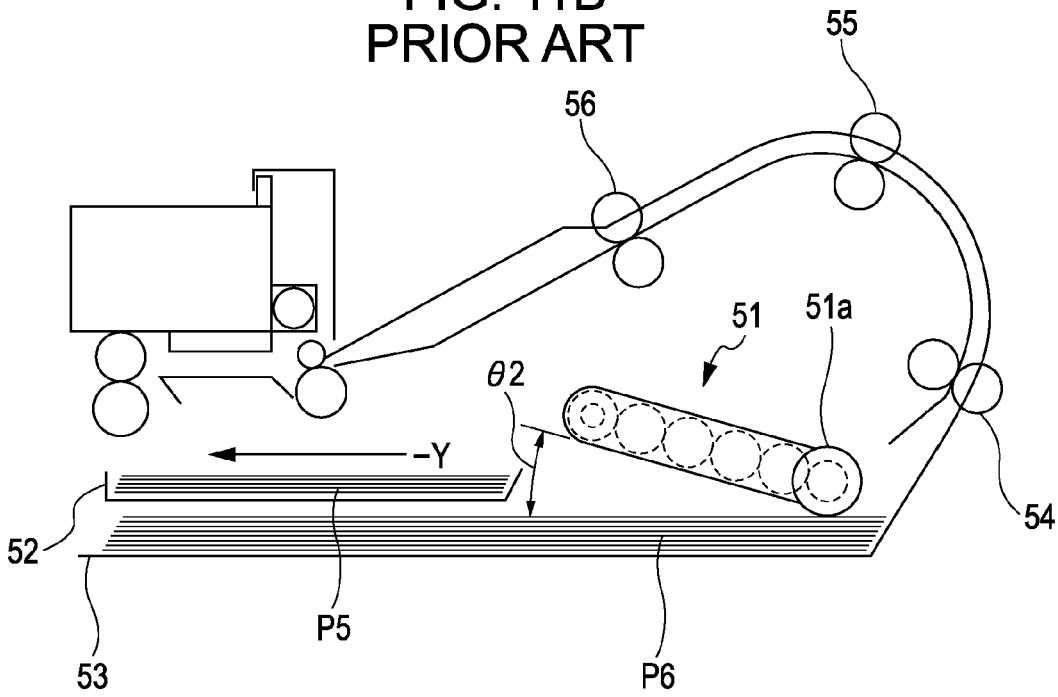
FIG. 11B PRIOR ART

FIG. 9 is a schematic top view showing the lower sheet material stacking unit 2, the upper sheet material stacking unit 3, and the feeding mechanism 4 included in the sheet material feeding device according to the third embodiment.

In the first embodiment, as a matter of general characteristics of the recording apparatus, the sheet material stacking units 2 and 3 and the feeding mechanism 4 (feeding roller 4*a*) are arranged with reference to a reference line A shown in FIG. 4 so that the reference feeding position in the sheet-material width direction coincides with the reference line A.

In contrast, in FIG. 9, the sheet material stacking units 2 and 3 and the feeding mechanism 4 (feeding roller 4*a*) are arranged such that the reference feeding position in the sheet-material width direction coincides with a reference line X extending substantially in the center of the sheet material. Also in such a configuration, the same advantageous effect as in the first embodiment can be produced. That is, a compact sheet material feeding device with a reduced height can be realized.

Fourth Embodiment

As a matter of descriptive convenience, the above-described embodiments in this specification concern a case where the upper sheet material stacking unit is controlled in accordance with a recording command and the like issued from the recording apparatus and is automatically moved with a power supplied from a drive source.

The sheet material feeding device of the present invention may also be embodied in such a manner that a user intentionally selects a sheet material stacking unit carrying a sheet material desired to be fed and manually moves the selected sheet material stacking unit. In such an embodiment, the advantageous effect of the present invention that a compact sheet material feeding device with a reduced height can be realized would not be reduced.

As a matter of descriptive convenience, the above-described embodiments in this specification concern a case where two, i.e., upper and lower, sheet material stacking units are provided. Alternatively, three or more sheet material stacking units may be provided. Also in the case of providing three or more sheet material stacking units, the advantageous effect of the present invention that a compact sheet material feeding device with a reduced height can be realized would not be reduced.

According to each of the embodiments of the present invention, a compact sheet material feeding device with a reduced height can be provided without increasing the complexity of the configurations of the sheet material stacking units and the feeding unit.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-283614 filed Oct. 31, 2007, which is hereby incorporated by reference herein in its entirety.

What is claimed is:

1. A sheet material feeding device in which sheet materials stacked in a plurality of sheet material stacking units are fed selectively, the device comprising:

a first sheet material stacking unit;

a second sheet material stacking unit disposed above the first sheet material stacking unit and movable relative to the first sheet material stacking unit;

a feeding roller movable between a first position where the feeding roller presses the sheet material stacked in the first sheet material stacking unit and a second position where the feeding roller is spaced apart from the first sheet material stacking unit;

a holding member holding the feeding roller when the feeding roller is at the second position and releasing the feeding roller when the second sheet material stacking unit is in a state of being retracted from a position between the first sheet material stacking unit and the feeding roller, thereby causing the feeding roller to press the sheet material stacked in the first sheet material stacking unit; and a pressing member configured to move the sheet material stacked in the second sheet material stacking unit toward the feeding roller so as to cause the sheet material to be pressed against the feeding roller, the pressing member causing the sheet material stacked in the second sheet material stacking unit to be pressed against the feeding roller when the second sheet material stacking unit is positioned between the first sheet material stacking unit and the feeding roller while the holding member is holding the feeding roller at the second position.

2. The sheet material feeding device according to claim 1, further comprising:

a support arm rotatably holding at one end thereof the feeding roller and swingably secured at the other end thereof to a body of the sheet material feeding device, the support arm being configured to swing about the other end thereof, thereby causing the feeding roller to press the sheet material.

3. The sheet material feeding device according to claim 2, wherein the holding member holds the support arm in a horizontal state when the feeding roller is at the second position.

4. The sheet material feeding device according to claim 1, wherein the pressing member includes:

a pressing plate disposed below the sheet material stacked in the second sheet material stacking unit; and a resilient member pushing up the pressing plate toward the feeding roller.

5. The sheet material feeding device according to claim 1, wherein the pressing member includes:

a pressing plate disposed below the sheet material stacked in the second sheet material stacking unit; and a resilient member pulling up the pressing plate toward the feeding roller.

6. A recording apparatus in which sheet materials stacked in a plurality of sheet material stacking units are fed selectively and recording on the sheet material that is fed is performed with a recording head, the apparatus comprising:

a head unit having the recording head;

a first sheet material stacking unit;

a second sheet material stacking unit disposed above the first sheet material stacking unit and movable relative to the first sheet material stacking unit;

a feeding roller movable between a first position where the feeding roller presses the sheet material stacked in the first sheet material stacking unit and a second position where the feeding roller is spaced apart from the first sheet material stacking unit;

a holding member holding the feeding roller when the feeding roller is at the second position and releasing the feeding roller when the second sheet material stacking unit is in a state of being retracted from a position between the first sheet material stacking unit and the feeding roller, thereby causing the feeding roller to press the sheet material stacked in the first sheet material stacking unit; and a pressing member configured to move the sheet material stacked in the second sheet material stacking unit toward the feeding roller so as to cause the sheet material to be pressed against the feeding roller, the pressing member causing the sheet material stacked in the second sheet material stacking unit to be pressed against the feeding roller when the second sheet material stacking unit is positioned between the first sheet material stacking unit and the feeding roller while the holding member is holding the feeding roller at the second position.

7. The recording apparatus according to claim 6, further comprising:

a support arm rotatably holding at one end thereof the feeding roller and swingably secured at the other end thereof to a body of the recording apparatus, the support arm being configured to swing about the other end thereof, thereby causing the feeding roller to press the sheet material.

8. The recording apparatus according to claim 7, wherein the holding member holds the support arm in a horizontal state when the feeding roller is at the second position.

9. The recording apparatus according to claim 6, wherein the pressing member includes:

a pressing plate disposed below the sheet material stacked in the second sheet material stacking unit; and a resilient member pushing up the pressing plate toward the feeding roller.

10. The recording apparatus according to claim 6, wherein the pressing member includes:

a pressing plate disposed below the sheet material stacked in the second sheet material stacking unit; and a resilient member pulling up the pressing plate toward the feeding roller.

* * * * *